US005673439A

United States Patent [19]

Kuo

[11] Patent Number: 5,673,439

[45] Date of Patent: Oct. 7, 1997

[54] TOILET DETERGENT DISPENSER

[76] Inventor: Chung Yen Kuo, No. 1058, Section 1, Chung-San Rd., Tachia, Taichung Hsien, Taiwan

[21] Appl. No.: 599,414

[22] Filed: Jan. 11, 1996

[51] Int. Cl.[6] ..... E03D 9/02

[52] U.S. Cl. ..... 4/222; 4/226.1; 4/227.1

[58] Field of Search ..... 4/222, 222.1, 223, 4/224, 226.1, 227.1, 903, DIG. 10, 309; 137/101.11; 210/198.1, 205

[56] References Cited

U.S. PATENT DOCUMENTS

| | | | |
|---|---|---|---|
| 521,411 | 6/1894 | Johnson | 4/226.1 |
| 1,110,620 | 9/1914 | Fraser | 4/224 |
| 4,937,892 | 7/1990 | Syrenne | 4/222 |
| 5,404,594 | 4/1995 | Ring et al. | 4/226.1 |
| 5,581,823 | 12/1996 | Kuo | 4/226.1 |

*Primary Examiner*—Henry J. Recla
*Assistant Examiner*—Charles R. Eloshway
*Attorney, Agent, or Firm*—Morton J. Rosenberg; David I. Klein

[57] ABSTRACT

A detergent dispenser for a toilet is mounted between a source conduit communicated with a water source and an inlet conduit communicated with a tank. The detergent dispenser includes a body having a cap removably mounted to a top thereof, an inlet defined in a bottom thereof and in communication with the source conduit, a separation plate mounted to the bottom thereof, thereby defining an inlet chamber in communication with the inlet and an outlet chamber in communication with the inlet conduit, and a compartment defined therein and communicating with the inlet chamber and the outlet chamber. A detergent support is mounted in the compartment for supporting a solid detergent thereon. A valve member is mounted to the inlet and includes a biasing member to urge the valve member to block the inlet when not flushing, and the valve member is moved upwardly when flushing such that water from the water source enters the compartment via the inlet chamber and passes through the mesh-like structure to dissolve the detergent and exits the body via the outlet chamber. A resilient water sealing member is mounted above the outlet chamber and allows the water which enters the compartment to exit the body via the outlet chamber during flushing and discommunicates the compartment and the outlet chamber when not flushing.

19 Claims, 4 Drawing Sheets

TOILET DETERGENT DISPENSER

BACKGROUND OF THE INVENTION

1. Field of the Invention

The present invention relates to a toilet detergent dispenser and, more particularly, to an automatic detergent dispenser which is mounted outside a toilet tank.

2. Description of Related Art

A typical method for cleaning a toilet bowl is to put a block of solid detergent in a tank generally disposed above the bowl, the solid detergent being dissolved by the water in the tank and the solution being subsequently released from the tank into the bowl to proceed with the flushing procedure, which is well known and therefore a detailed description is not required. However, it is found that the detergent is often over-dissolved and has an uncertain concentration, resulting in waste in the detergent as well as poor efficiency.

A proposal has been made to dispose a detergent dispenser in the tank which is intended to dispense a certain amount of detergent into the water in the tank. Yet an apparent disadvantage thereof is that replacement of the dispenser is inconvenient as the user has to remove the tank lid first and that the hands of the user may be undesiredly wetted. In addition, the dispensed amount of the dispenser is generally controlled by the float ball which sometimes malfunctions and thus fails to perform the function of effectively blocking a valve seat in the tank, thereby resulting in a waste in the detergent and water.

Therefore, there has been a long and unfulfilled need for an improved toilet detergent dispenser to mitigate and/or obviate the above problems.

SUMMARY OF THE INVENTION

In accordance with one aspect of the present invention, a detergent dispenser for a toilet is mounted between a source conduit which is communicated with a water source and an inlet conduit which is communicated with a tank. The detergent dispenser generally includes a body comprising a cap removably mounted to a top thereof, an inlet defined in a bottom thereof and in communication with the source conduit, a separation plate mounted to the bottom thereof, thereby defining an inlet chamber in communication with the inlet and an outlet chamber in communication with the inlet conduit and a compartment defined therein and communicating with the inlet chamber and the outlet chamber, a detergent support being mounted in the compartment for supporting a solid detergent thereon. A valve means is mounted to the inlet and includes a biasing means to urge the valve means to block the inlet when not flushing, and the valve means is moved upwardly when flushing such that water from the water source enters the compartment via the inlet chamber and passes through the mesh-like structure to dissolve the detergent and then exits the body via the outlet chamber. A resilient water sealing means is mounted above the outlet chamber and allows the water which enters the compartment to exit the body via the outlet chamber during flushing and discommunicates the compartment with the outlet chamber when not flushing.

In accordance with a further aspect of the invention, the detergent dispenser comprises a body having an upper open end and a cap removably mounted to a top thereof. The body further includes an inlet defined in a bottom thereof and in communication with the source conduit, and a separation plate mounted to the bottom thereof, thereby defining an inlet chamber in communication with the inlet and an outlet chamber in communication with the inlet conduit. A separation disc is securely mounted in the body above the separation plate and defines a first hole in communication with the inlet chamber, a second hole in communication with the outlet chamber, a central tubular member extending downwardly from an underside thereof above the outlet chamber and defining a bore therethrough, and a recess defined in an underside thereof. A first valve means has a first end mounted to the inlet and a second end extending in the bore of the tubular member. A biasing means is provided in the body for biasing the first valve means to block the inlet when not flushing. A fixing plate is mounted in the body above the separation disc and has a water path defined therein, a first compartment being defined between the fixing plate and the separation disc and in communication with the inlet chamber and the outlet chamber. A detergent support is mounted in the body above the fixing plate and has a mesh-like structure for supporting a solid detergent thereon, a second compartment being defined between the fixing plate and the detergent support and in communication with the first compartment via the water path. A second valve means is mounted in the water path and actuatable by the first valve means.

The first and second valve means respectively block the inlet of the body and the water path between the first and second compartments when not flushing, and the first and second valve means are moved upwardly when flushing such that water from the water source enters the first and second compartments via the inlet chamber and passes through the mesh-like structure to dissolve the detergent and exits the body via the outlet chamber.

A resilient water sealing means is mounted to the recess of the separation disc and allows the water which enters the first compartment to exit the body via the outlet chamber during flushing and to discommunicate the first compartment with the outlet chamber when not flushing.

In a preferred embodiment of the invention, the first valve means includes a valve member having a sealing element with a conic lower end and a gasket mounted thereon for blocking the inlet when desired, a tappet projecting upwardly from the valve member and extending in the bore of the tubular member of the separation disc to urge the second valve means upwardly when flushing.

The second valve means includes an elongate member having a lower flange, a mediate flange, and an upper flange formed thereon, the lower flange being actuatable by the first valve means. A first reduced section is defined between the lower and mediate flanges and is received in the water path, a second reduced section is defined between the mediate flange and the upper flange and generally above the fixing plate, and a water seal gasket is mounted around the second reduced section to block the water path when not flushing. A spring has a lower end securely attached to the lower flange and an upper end bearing against the fixing plate.

Preferably, the body includes an annular ledge projecting outwardly from an inner periphery thereof, and the separation plate is mounted on the annular ledge. The body may include an outlet conduit integrally formed on an outer peripheral wall thereof and interconnected between the outlet chamber and the inlet conduit. The outlet conduit includes a barbed structure formed on an outer periphery thereof for securely engaging with the inlet conduit.

The body includes a plurality of stubs formed on the bottom thereof and each having a threaded periphery defining a hole therein, and the fixing plate includes a corresponding number of holes defined therein each of which a screw is extended to be threadedly received in the hole in the associated stub for positioning.

The resilient water sealing member includes a flexible piece which blocks the second hole of the separation disc when not flushing and which allows the water to pass therethrough to the outlet chamber when flushing.

Preferably, the fixing plate includes a guiding member which is disposed in a center thereof to define the water path therein.

The body includes a threaded outer periphery in an upper portion thereof, and the cap includes a threaded inner periphery for removably engaging with the threaded outer periphery of the body. The cap may further include a water seal ring mounted between an underside thereof and an upper surface of the body. Furthermore, the cap may further include a polygonal member formed on an upper side thereof so as to be operated by a tool.

Other objects, advantages, and novel features of the invention will become more apparent from the following detailed description when taken in conjunction with the accompanying drawings.

DESCRIPTION OF THE PREFERRED EMBODIMENT

Figure 1:
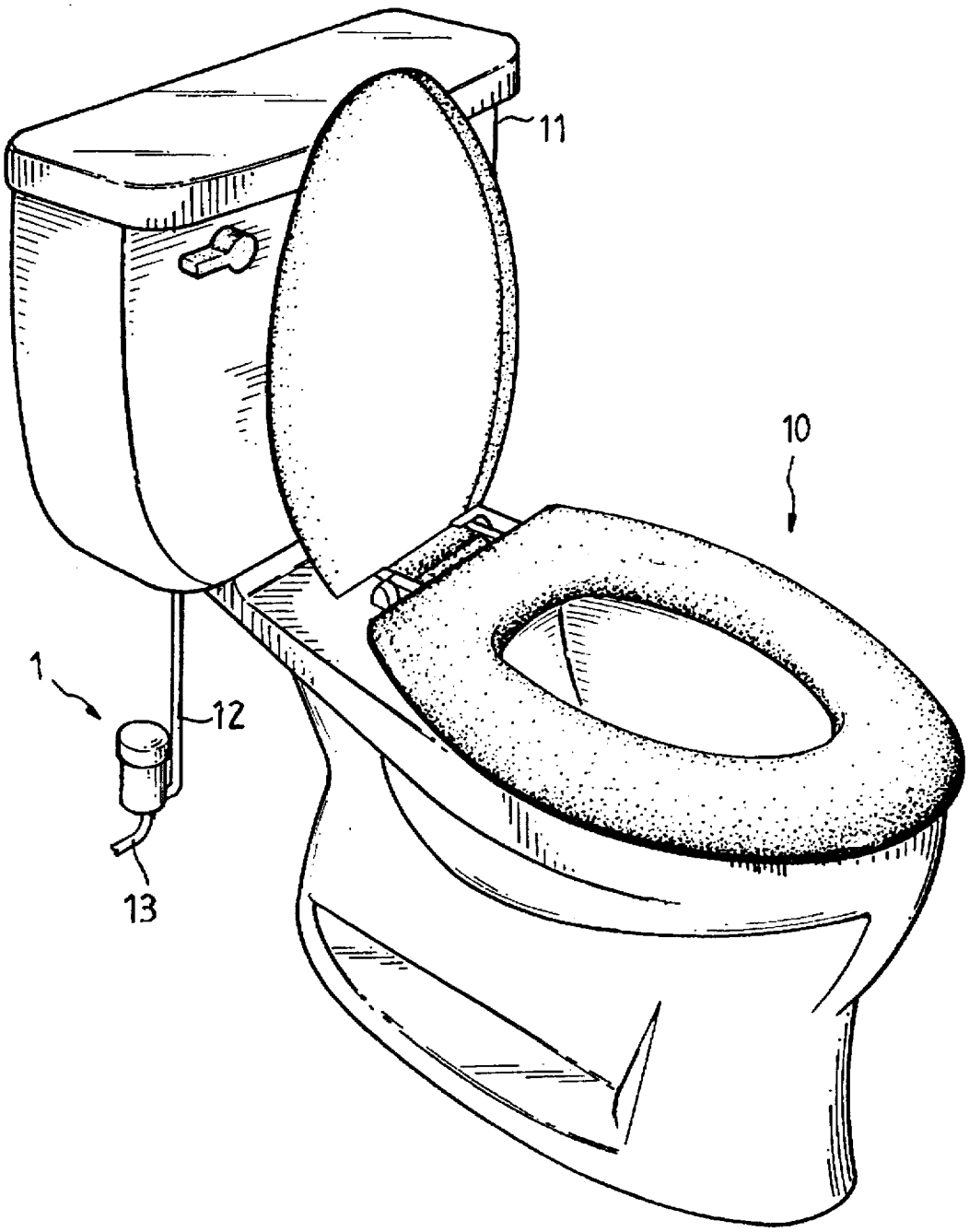
FIG. 1 is a perspective view of a toilet with a detergent dispenser in accordance with the present invention.

Referring to the drawings and initially to FIG. 1, a toilet generally includes a bowl 10, a tank 11, an inlet conduit 12 having a first end communicated with the tank 11, and a source conduit 13 having a first end communicated with a second end of the inlet conduit 12 and a second end communicated with a water source (not shown), a structure of which is well known and therefore further detailed description thereof is not required. The present invention features that a detergent dispenser is mounted between the inlet conduit 12 and the source conduit 13.

Figure 2:
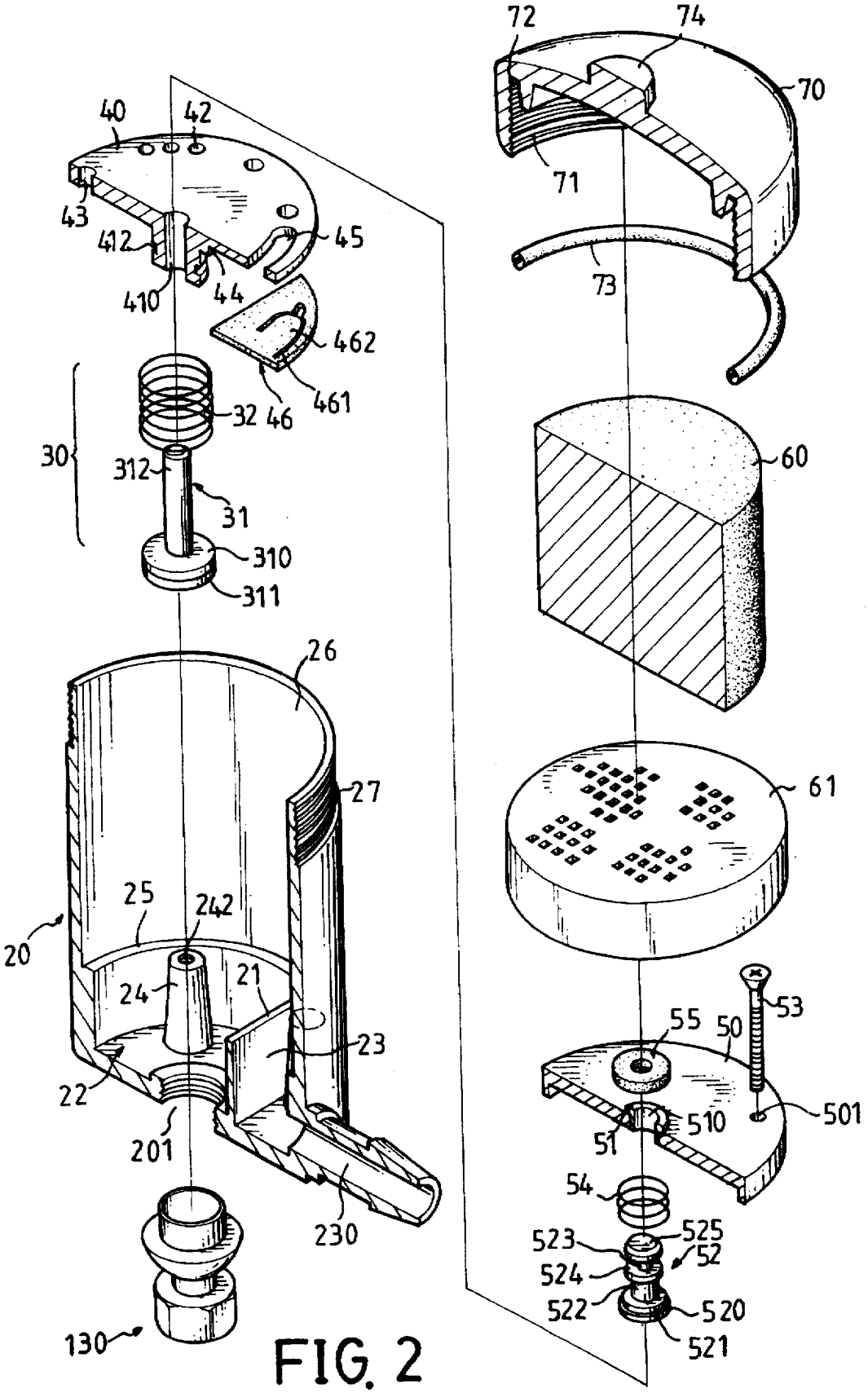
FIG. 2 is an exploded view, partly-sectioned, of the detergent dispenser in accordance with the present invention.
Figure 3:
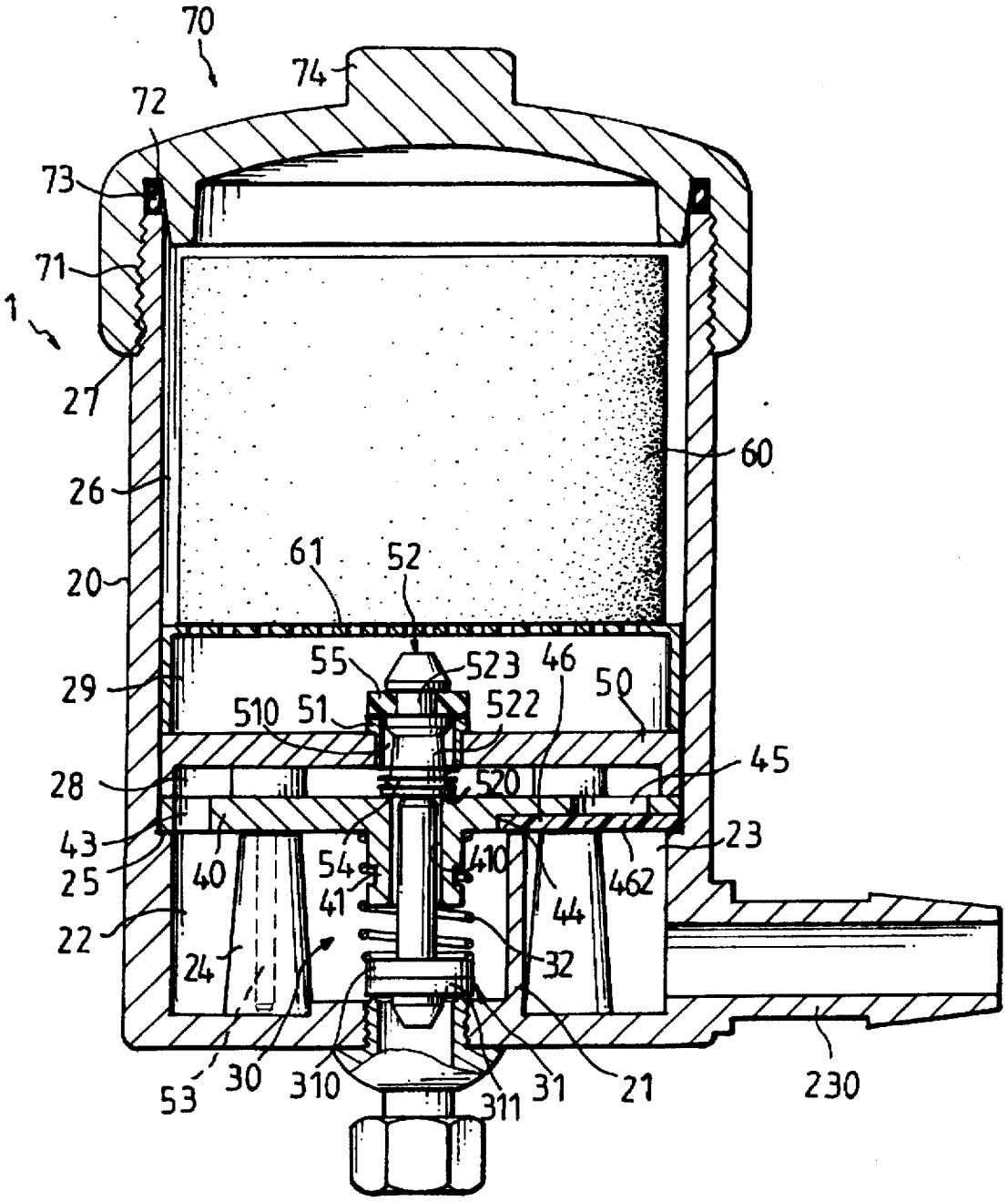
FIG. 3 is a cross-sectional view of the detergent dispenser in accordance with the present invention.

Referring now to FIGS. 2 and 3, the detergent dispenser, designated by reference numeral "1", includes a substantially cylindrical body 20 with an open upper end. An inlet 201 is centrally defined in a bottom of the body 20, and a separation plate 21, which substantially extends along a longitudinal direction of the body 20, is provided on the bottom of the body 20 at a position other than the inlet 201, thereby separating a lower part of the body 20 into an inlet chamber 22 in communication with the inlet 21 and an outlet chamber 23. An outlet conduit 230 is preferably integrally formed on a peripheral wall of the body 20 and communicates between the outlet chamber 23 and the inlet conduit 12. Preferably, the outlet conduit 230 includes barbed structure on an outer periphery thereof for mounting the inlet conduit 12 (which may be a hose) thereon.

A plurality of stubs 24 are spacedly formed on the bottom and each have a threaded periphery defining a hole 242 therein. An annular ledge 25 extends from an inner peripheral wall of the body 20 and is preferably at a height the same as that of the stubs 24. A separation disc 40 is mounted on the annular ledge 25 and includes a plurality of holes 43 which communicate with the inlet chamber 22. In addition, a recess 44 is defined in an underside of the separation disc 40 in an area corresponding to the outlet chamber 23, and an elongate hole 45 is defined in the separation disc 40 and communicates with the outlet chamber 23 via the recess 44. A resilient sealing plate 46 is received in the recess 44 and includes a flexible piece 462 which is formed by cutting the resilient sealing plate 46 to simultaneously form a substantially U-shaped slit 461 and the flexible piece 462. It is appreciated that flexible piece 462 includes an area greater than that of the elongate 45 and normally effectively seals the elongate hole 45 from the underside of the disc 40 as being resilient. The disc 40 further includes a central tubular member 41 extending downwardly from an underside thereof and defining a bore 410 therethrough, the purpose of which will be explained hereinafter.

A first valve means 30 includes a first valve member 31 mounted to block the inlet 201 of the body 20 when not flushing under the action of a first biasing member, such as a spring 32. The first valve member 31 includes a sealing element 310 (see FIG. 3) with a conic lower end and having a gasket 311 mounted thereon for blocking the inlet 201 when desired. Preferably, the gasket 311 is made of suitable material to provide the desired sealing. A joint 130 is mounted to the inlet 201 by threading connection and includes a lower end for connecting with the source conduit 13 and an upper end which is preferably extended to a position slightly above the inlet 201 to fittingly receive the gasket 311, thereby achieving a better sealing effect. The first valve member 31 further includes a tappet 312 which projects upwardly from the sealing element 310 and extends in the bore 410 of the tubular member 41, while an upper end of the spring 32 is mounted to an annular recess 412 defined in an outer periphery of the tubular member 41 and a lower end of the spring 32 abuts against the sealing element 310, thereby biasing the sealing element 310 downwardly to seal the inlet 201 when not flushing.

A fixing plate 50 is mounted above the disc 40 and defines a first compartment 28 therebetween. The fixing plate 50 includes a plurality of holes 501 defined therein each aligning with a corresponding hole 42 in the disc 40 and a corresponding stub 24 such that the fixing plate 50 and the separation disc 40 are positioned by means of bolts or screws 53 extending through holes 501 and 42 and threadedly received in the holes 242 in the corresponding stubs 24. The fixing plate 50 further includes a central guiding member 51 defining a water path 510 therein in which a second valve means 52 is mounted.

The second valve means 52 is substantially an elongate member having a lower flange 520, a mediate flange 524, and an upper flange 525 (see FIG. 2) formed thereon. The lower flange 520 rests on and thus is actuatable by a top of the tappet 312 of the first valve means 30, and a lower end of a spring 54 is received in a notch 521 or other suitable provision on the lower flange 520. Art upper end of the spring 54 bears against a lower part of the guiding member 51. As shown in FIG. 3, a first reduced section 522 defined between the lower and mediate flanges 520 and 524 is received in the water path 510 and has a diameter less than an inner diameter of the water path 510. A second reduced section 523 defined between the mediate flange 522 and the upper flange 525 is generally above the guiding member 51 and a water seal gasket 55 is mounted around the second reduced section 523 to block the water path 510.

Mounted above the fixing plate 51 is a detergent support 61 which is substantially U-shaped in section and includes an open lower end (not labeled), thereby defining a second compartment 29 between the fixing plate 51 and the detergent support 61. The detergent support 61 includes a mesh-like structure in an upper surface thereof which supports a solid detergent 60 thereon in a third compartment 26 defined between the detergent support 61 and the body 20.

The body 20 further includes a threaded upper outer periphery 27 for removably engaging with a cap 70 which includes a threaded inner periphery 71. The cap 70 further includes a water seal ring 73 received in an annular groove 72 defined above the threaded inner periphery 71. The seal ring 73 rests on an annular upper surface of the body 20 (see FIG. 3) to provide a sealing effect. Preferably, a polygonal member 74 is formed on an upper surface of the cap 74 such that the user may use a wrench or spanner to remove/mount the cap 74 when replacing a new detergent 60.

Figure 4:
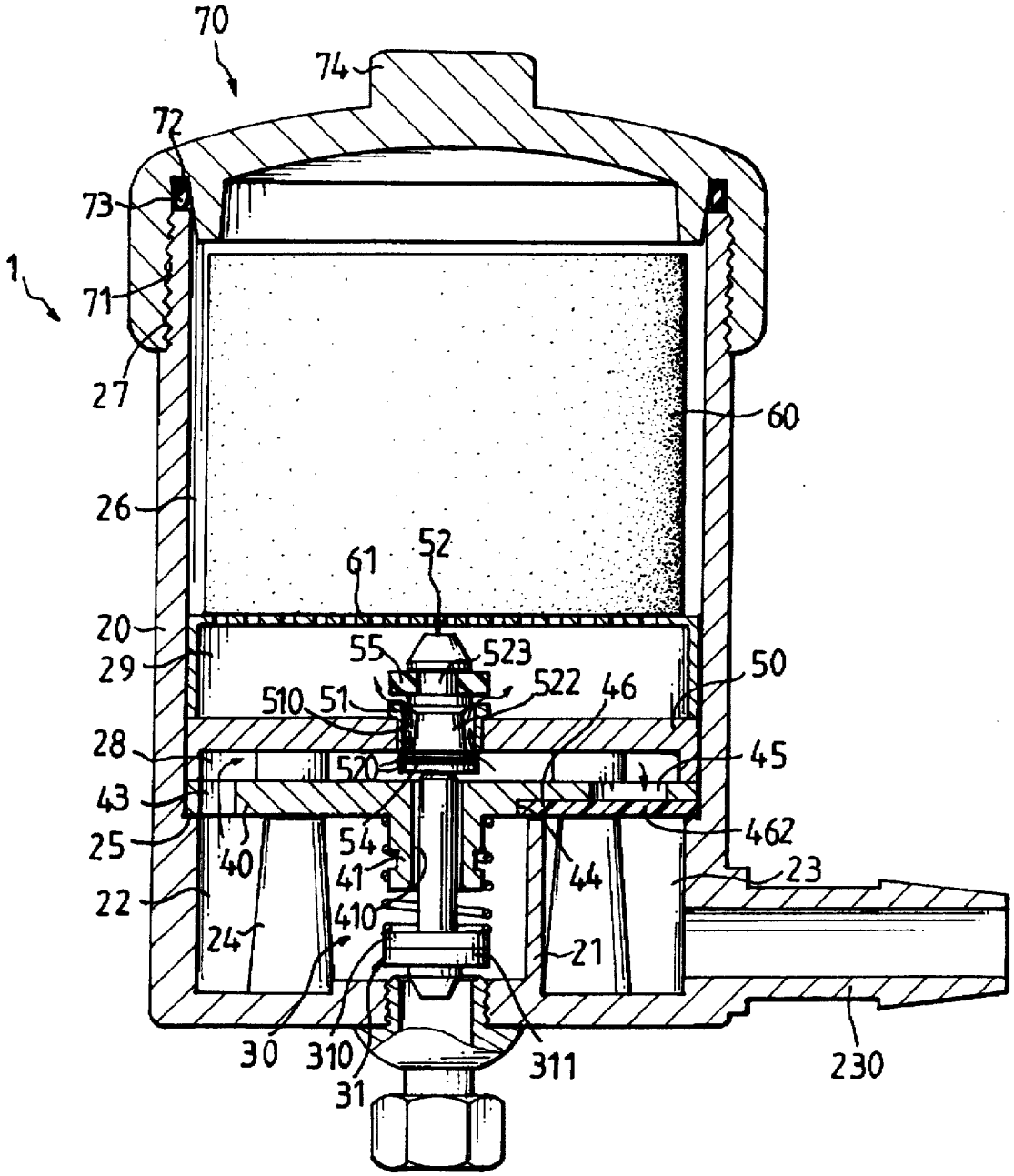
FIG. 4 is a cross-sectional view similar to FIG. 3, illustrating operation of the detergent dispenser.

Still referring to FIGS. 1–3 and further to FIG. 4, when flushing, water in the tank 11 flows into the bowl 10, and water from the water source enters the inlet chamber 22 of the body 20 via the conduit 13, the joint 130, and the inlet 201 to push the first valve member 31 as well as the second valve means 52 upwardly. At this moment, the water/detergent solution in the compartments 26 and 29 flows into the compartment 28, while the incoming water from the inlet chamber 22 enters the compartment 28 via holes 43 and combines with the water/detergent solution. The combined water/solution passes through the hole 45 (the flexible piece 462 is moved downwardly by the water/solution to expose the slot 45) and exits the body 20 via the outlet chamber 23 and the outlet conduit 230 to fill the tank 11 for next flushing. A part of the incoming water may enter the compartment 26 via the water path 510, the compartment 29 and the mesh-like structure of the detergent support 61 for dissolving the detergent 60. After the tank 11 is filled, the incoming water is stopped as the first valve member 31 is moved downwardly under the action of the spring 32 to block the inlet 201 while the second valve means 52 is simultaneously moved downwardly to block the water path 510. Accordingly, only the water above the fixing plate 50 may dissolve the detergent, thereby controlling the amount of the detergent to be solved. It is appreciated that the water level in the compartment 29 is slightly higher than the mesh-like structure to provide efficient dissolving effect.

Although the invention has been explained in relation to its preferred embodiment, it is to be understood that many other possible modifications and variations can be made without departing from the spirit and scope of the invention as hereinafter claimed.

What is claimed is:

1. A detergent dispenser for a toilet having a tank, a bowl, a source conduit communicated with a water source, an inlet conduit interconnected between the tank and the source conduit, the detergent dispenser adapted to be mounted between the source conduit and the inlet conduit and comprising:

a body having an upper open end and comprising:

a cap removably mounted to a top thereof;

an inlet defined in a bottom thereof and in communication with the source conduit;

a separation plate mounted to the bottom thereof, thereby defining an inlet chamber in communication with the inlet and an outlet chamber in communication with the inlet conduit;

a compartment defined therein and communicating with the inlet chamber and the outlet chamber, a detergent support being mounted in the compartment for supporting a solid detergent thereon;

a valve means mounted to the inlet and including a biasing means to urge the valve means to block the inlet when not flushing, and the valve means being moved upwardly when flushing such that water from the water source enters the compartment via the inlet chamber and passes through the detergent support to dissolve the detergent and exits the body via the outlet chamber; and a resilient water sealing means mounted above the outlet chamber and allowing the water which enters the compartment to exit the body via the outlet chamber during flushing and discommunicating the compartment and the outlet chamber when not flushing.

2. The detergent dispenser as claimed in claim 1, wherein the body includes an outlet conduit integrally formed on an outer peripheral wall thereof and adapted to be interconnected between the outlet chamber and the inlet conduit.

3. The detergent dispenser as claimed in claim 2, wherein the outlet conduit includes a barbed structure formed on an outer periphery thereof for securely engaging with the inlet conduit.

4. The detergent dispenser as claimed in claim 1, wherein the body includes a threaded outer periphery in an upper portion thereof, and the cap includes a threaded inner periphery for removably engaging with the threaded outer periphery of the body.

5. The detergent as claimed in claim 4, wherein the body includes an upper surface, and the cap further includes a water seal ring mounted between an underside thereof and the upper surface of the body.

6. The detergent as claimed in claim 4, wherein the cap further includes a polygonal member formed on an upper side thereof so as to be operated by a tool.

7. A detergent dispenser for a toilet having a tank, a bowl, a source conduit communicated with a water source, an inlet conduit interconnected between the tank and the source conduit, the detergent dispenser adapted to be mounted between the source conduit and the inlet conduit and comprising:

a body having an upper open end and comprising:

a cap removably mounted to a top thereof;

an inlet defined in a bottom thereof and adapted for communication with the source conduit; and a separation plate mounted to the bottom thereof, thereby defining an inlet chamber in communication with the inlet and an outlet chamber in communication with the inlet conduit;

a separation disc securely mounted in the body above the separation plate and defining a first hole in communication with the inlet chamber, a second hole in communication with the outlet chamber, a central tubular member extending downwardly from an underside thereof and defining a bore therethrough, and a recess defined in an underside thereof above the outlet chamber;

a first valve means having a first end mounted to the inlet and a second end extending in the bore of the tubular member;

a biasing means for biasing the first valve means to block the inlet when not flushing;

a fixing plate mounted in the body above the separation disc and having a water path defined therein, a first compartment being defined between the fixing plate and the separation disc and in communication with the inlet chamber and the outlet chamber;

a detergent support mounted in the body above the fixing plate and having a mesh-like structure for supporting a solid detergent thereon, a second compartment being defined between the fixing plate and the detergent support and in communication with the first compartment via the water path;

a second valve means mounted in the water path and actuatable by the first valve means;

the first and second valve means respectively blocking the inlet of the body and the water path between the first and second compartments when not flushing, and the first and second valve means being moved upwardly when flushing such that water from the water source enters the first and second compartments via the inlet chamber and water path and passes through the mesh-like structure to dissolve the detergent and exits the body via the outlet chamber; and a resilient water sealing means mounted to the recess of the separation disc and allowing the water which enters the first compartment to exit the body via the outlet chamber during flushing and to discommunicate the first compartment and the outlet chamber when not flushing.

8. The detergent dispenser as claimed in claim 7, wherein the first valve means includes a valve member having a sealing element with a conic lower end and a gasket mounted thereon for blocking the inlet, and a tappet projecting upwardly from the valve member and extending in the bore of the tubular member of the separation disc to urge the second valve means upwardly when flushing.

9. The detergent as claimed in claim 7, wherein:

the second valve means includes an elongate member having a lower flange, a mediate flange, and an upper flange formed thereon, the lower flange is actuatable by the first valve means, a first reduced section is defined between the lower and mediate flanges and is received in the water path, a second reduced section is defined between the mediate flange and the upper flange and generally above the fixing plate, and a water seal gasket is mounted around the second reduced section to block the water path when not flushing.

10. The detergent dispenser as claimed in claim 9, further comprising a spring having a lower end securely attached to the lower flange and an upper end bearing against the fixing plate.

11. The detergent dispenser as claimed in claim 7, wherein the body includes an annular ledge projecting outwardly from an inner periphery thereof, and the separation plate is mounted on the annular ledge.

12. The detergent dispenser as claimed in claim 7, wherein the body includes an outlet conduit integrally formed on an outer peripheral wall thereof and adapted to be interconnected between the outlet chamber and the inlet conduit.

13. The detergent dispenser as claimed in claim 12, wherein the outlet conduit includes a barbed structure formed on an outer periphery thereof for securely engaging with the inlet conduit.

14. The detergent dispenser as claimed in claim 7, wherein the body includes a plurality of stubs formed on the bottom thereof and each having a threaded periphery defining a hole therein, and the fixing plate includes a corresponding number of holes defined therein each of which for receiving a screw to be threadedly received in the hole in the associated stub for positioning.

15. The detergent dispenser as claimed in claim 7, wherein the resilient water sealing member includes a flexible piece which blocks the second hole of the separation disc when not flushing and which allows the water to pass therethrough to the outlet chamber when flushing.

16. The detergent dispenser as claimed in claim 7, wherein the fixing plate includes a guiding member which is disposed in a center thereof to define the water path therein.

17. The detergent dispenser as claimed in claim 7, wherein the body includes a threaded outer periphery in an upper portion thereof, and the cap includes a threaded inner periphery for removably engaging with the threaded outer periphery of the body.

18. The detergent as claimed in claim 17, wherein the body includes an upper surface, and the cap further includes a water seal ring mounted between an underside thereof and the upper surface of the body.

19. The detergent as claimed in claim 17, wherein the cap further includes a polygonal member formed on an upper side thereof so as to be operated by a tool.

* * * * *